United States Patent [19]

Wullenwaber

[11] 4,171,051

[45] Oct. 16, 1979

[54] APPARATUS FOR SERIALLY TRANSPORTING, TESTING AND ORIENTING CYLINDRICAL COMPONENTS

[76] Inventor: Robert W. Wullenwaber, 1141 St. Regis Pl., Santa Ana, Calif. 92705

[21] Appl. No.: 756,638

[22] Filed: Jan. 4, 1977

[51] Int. Cl.[2] ..... B07C 5/08

[52] U.S. Cl. ..... 209/542; 209/574; 209/911; 221/10

[58] Field of Search ..... 209/73, 74 R, 81 R, 209/542, 573, 574, 541, 540, 911; 198/400, 406, 409, 410; 221/10

[56] References Cited

U.S. PATENT DOCUMENTS

| | | | |
|---|---|---|---|
| 2,975,878 | 3/1961 | Cason | 209/81 R X |
| 3,115,235 | 12/1963 | Othon | 209/81 R X |
| 3,298,564 | 1/1967 | Wheatley et al. | 221/10 |
| 3,810,540 | 5/1974 | Georges | 209/81 R X |
| 3,960,267 | 6/1976 | Valo | 198/410 |

FOREIGN PATENT DOCUMENTS

| | | | |
|---|---|---|---|
| 2364311 | 6/1975 | Fed. Rep. of Germany | 198/400 |

*Primary Examiner*—Joseph J. Rolla
*Attorney, Agent, or Firm*—William L. Chapin

[57] ABSTRACT

A multi-section feeder-serializer subsystem uses blocking gates controlled by sensors responsive to the quantity of components in the various sections to produce a single-file progression of components from a bulk supply of components. A slotted track conveys a single file progression of components to a testing station where opposed bifurcated jaws grasp a single selected component from the progression and perform tests on the selected component. An orienting station coupled to the output of the testing station by a second slotted track employs mechanical fingers to rotate selected components either plus or minus 90 degrees about a vertical axis.

4 Claims, 16 Drawing Figures

FIG. 3
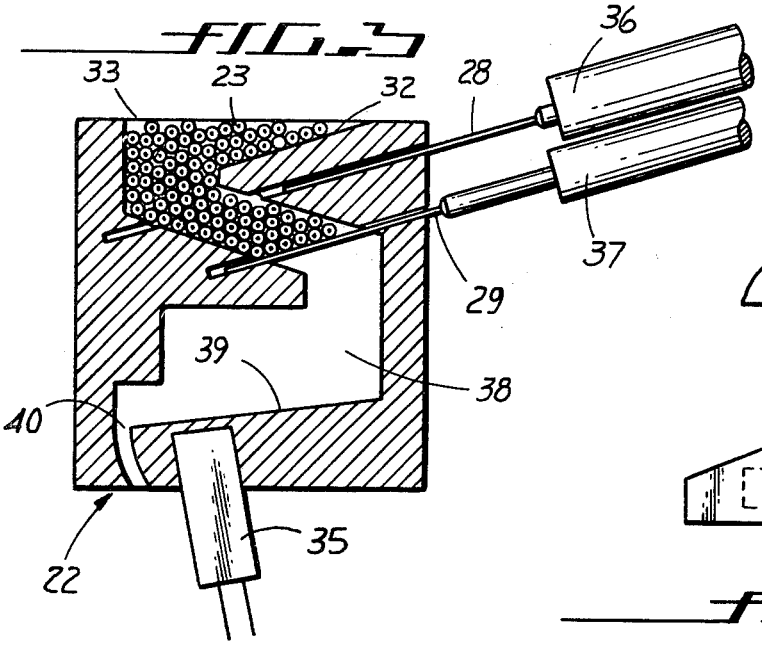
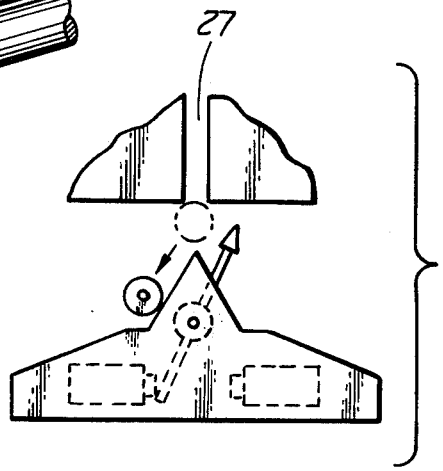
FIG. 12
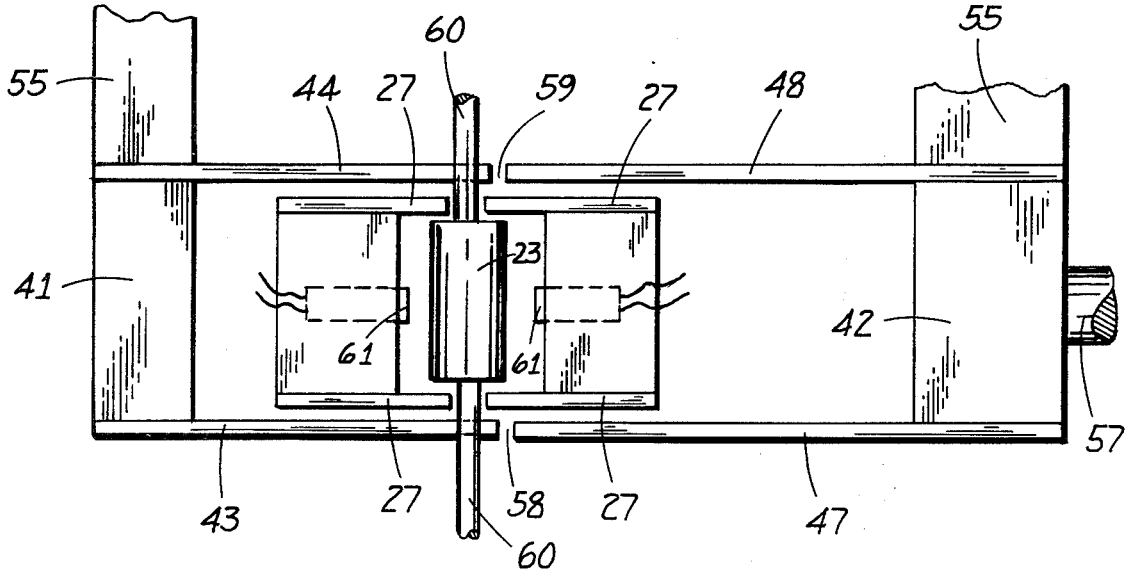
FIG. 13

APPARATUS FOR SERIALLY TRANSPORTING, TESTING AND ORIENTING CYLINDRICAL COMPONENTS

BACKGROUND OF THE INVENTION

Many types of manufacturing operations require the transmission of individual cylindrical components to an assembly station for automatic or manual incorporation of the component into a product or subassembly. In particular, the manufacture of electronic products frequently utilizes large numbers of axial lead electronic components, such as resistors, diodes and capacitors. These components are often obtained in bulk, and must be dispensed serially in a manner permitting their utilization in such operations as automatic or manual insertion into circuit boards.

Some manufacturing operations require testing of bulk components before their use in succeeding manufacturing operations. Also, non-bilateral symmetry devices such as semiconductor diodes require proper orientation before insertion into circuit assemblies, and means must be provided to provide 180 degree, end-for-end rotation of those devices which are improperly oriented.

The abovementioned requirements for rapidly feeding, testing and orienting axial lead components have understandably stimulated a great deal of inventive activity directed towards producing machines capable of rapid and efficient performance of the parts-handling tasks. That activity has resulted in the disclosure of a large variety of machinery of varying capabilities, as a study of the prior art will reveal.

Accordingly, an exhaustive summary of the prior art would be too lengthy and not suit the purposes of this disclosure. Instead, certain general features and drawbacks of previously disclosed machinery will be mentioned, to facilitate an appreciation of the advantages offered by the present invention.

A common method of serializing axial lead components from a bulk stock is to employ a vibrating bowl. Bulk components are fed into the bowl, and vibrations of the bowl, in conjunction with the force of gravity, cause components to align with an exit of the bowl. Parts leaving the bowl enter a vertically disposed track. The longitudinal interior cross section of the track is just slightly larger than the body of the axial lead component, maintaining components within the track in a serialized, single file disposition. Longitudinal slots run the full length of two parallel sides of the track. The slots are wide enough to permit the component leads to protrude through the slot, yet small enough to prevent the body of the component from protruding through the slot.

The parts-carrying tracks often have a zig-zag, or sawtooth slot disposition, rather than being straight tracks. The zig-zag path slows the vertical descent rate of the part to a desired value less than what would be achieved by free-fall of the parts. Furthermore, parts queing which occurs at sawtooth vertices tends to bring parts within the track into an adjacent, parallel configuration, with bodies of the parts essentially horizontal.

Parts that have once entered the zig-zag track from a vibratory bowl feeder usually travel without difficulty. However, vibratory bowl feeders are frequently plagued by jams occurring within the bowl and at the bowl exit. Also, the susceptibility to jamming of vibratory bowl feeders is aggravated by even slight bends in the component leads.

To handle components with magnetic leads, feeders using magnetic fields have been frequently employed. One obvious disadvantage of magnetic-field feeders is the limitation of their usage to components having magnetic leads. Also, most magnetic component handlers employ a flux field that holds components in stable equilibrium independent of component polarity. The polarity-insensitivity occasionally permits a part to flip over to an incorrect orientation.

Other axial lead component handling machines have employed air jets or vacuum, or a combination of the two, or contacting mechanical actuators to force the components into wheels or slots prior to testing or routing the components to subsequent manufacturing stations. These machines generally require that the components be first brought into parallel alignment and serialized, using a vibratory bowl feeder for example. An additional disadvantage of the present class of machines is their susceptibility of jamming, aggravated by out-of-tolerance components or components with bent leads.

Several drawbacks are common to all previously-disclosed axial-lead components handling machines. These include: Complexiy, cost, jam-susceptibility, difficulty of maintaining and limited parts-handling rate capabilities.

The present invention overcomes the above-described shortcomings of previous methods of handling cylindrical components. It possesses novel features that afford superior performance of the tasks of serializing bulk components for single-file distribution, testing the components, orienting components to either of two positions opposed 180 degrees from one another, rejecting out-of-tolerance components, and delivering oriented parts to a destination selected from a plurality of available destinations.

The present invention is well-adapted to function at high through-put rates of tens of thousands of parts per hour. The three major subsystems of the machine, namely, the feeder-serializer, the test station, and the orienter are each capable of functioning as independent units. Thus, all or some of the subassemblies may be used in various combinations to suit the particular user's parts feeding and serializing, testing and orienting requirements.

Several novel features of the invention together provide the high parts-handling rate capability.

For example, the test head, as is described in more detail below, employs linearly actuated inclined planes to grasp a component to be tested, force the component into the test position, and force the tested component out of the test position upon completion of the test. This test head actuation method overcomes the speed limitations inherent in testing methods relying primarily on gravity to move components under test.

Also contributing to the high speed capability of the present invention is the fact that components are tested while remaining in the feeder track which routes the components to and from the test station. This eliminates time-consuming transfer operations to and from the test station, as are required with previously existing methods.

The present invention is well adapted to high-speed handling of small cylindrical parts in addition to axial lead electronic components, as will be apparent from the following descriptions.

OBJECTS OF THE INVENTION

An object of the presently disclosed invention is to provide means for serially dispensing cylindrical components obtained from bulk stocks. Another object of the invention is to provide means for transporting cylindrical components single-file from one processing station to another. Another object of the invention is to provide means for rapidly transferring cylindrical components obtained from bulk stocks to a serial progression of components.

Another object of the invention is to provide means for testing individual components in a serial progression of components.

Another object of the invention is to provide means for directing components individually selected from a single-file progression of components to a destination selected from a plurality of available destinations.

Another object of the invention is to provide orienting means enabling 180 degree, end-for-end relative rotation of selected components in a serial progression of components. Another object of the invention is to provide means for rapidly producing a single-file progression of components from a bulk stock of components, transporting the components to at least one succeeding destination point, testing individual components in a single-file progression of components, performing a 180-degree relative rotation of selected components, and directing selected components to a location selected from a plurality of available locations.

Various other objects and advantages of the present invention will appear from the following descriptions of one embodiment of the invention, and the most novel features will be particularly pointed out hereinafter in connection with the appended claims.

BRIEF SUMMARY OF THE INVENTION

Briefly stated, this invention comprehends an apparatus for serially dispensing and feeding cylindrical components obtained from bulk stocks, testing individual components, orienting the components and transmitting in-tolerance, properly oriented components to one destination, and rejected parts to another.

The feeder-serializer subsystem comprises an upper entrance section adapted to receive cylindrical components that have previously been brought into substantially parallel alignment, an intermediate holding chamber for components, and a bottom exit chamber. A mechanical gate admits or excludes parts from falling into the intermediate chamber from the entrance section, and a similar gate alternatively allows or prevents gravity transfer of parts from the holding chamber to a third, bottom section of the feeder-serializer. Parts falling through an exit slot in the bottom section enter single-file into a slotted transfer track, subsequently to be transferred under the force of gravity to succeeding processing stations.

A testing station downstream from the feeder-serializer employs pairs of jaws on either side of the transfer track to segregate, test and return to the component progression individual components.

An orienting station downstream from the testing station employs mechanical fingers to rotate selected components either plus or minus 90 degrees. This enables 180-degree relative rotation of selected components exiting from the orienting station. Additionally, the orienter has means for directing selected components, as for example out-of-tolerance components, to at least one other destination different from the destination of the oriented parts.

BRIEF DESCRIPTION OF THE DRAWINGS

FIG. 3 is a partly sectional front elevation view of the feeder-serializer showing components filling the upper and intermediate chambers at the start of a feeding cycle.

FIG. 12 is a front elevation view of the orienter showing the rightward (clockwise) simultaneous motion of control levers to effect motion of a selected component downward and to the left of FIG. 13 is a top plan view of the test head.

DESCRIPTION OF THE PREFERRED EMBODIMENT

Figure 2:
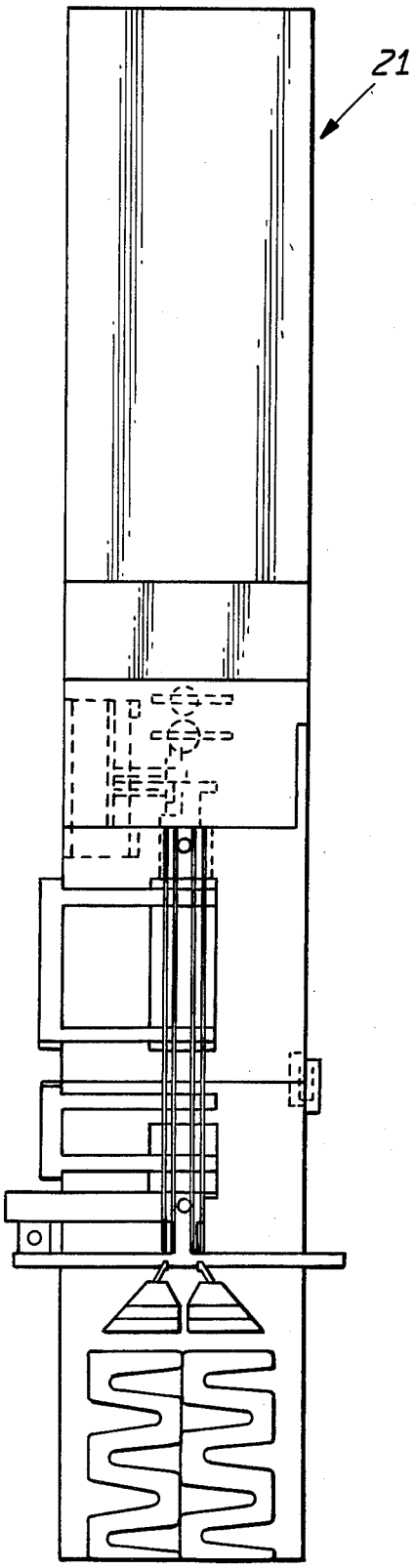
FIG. 2 is a side elevation view of the machine.
Figure 1:
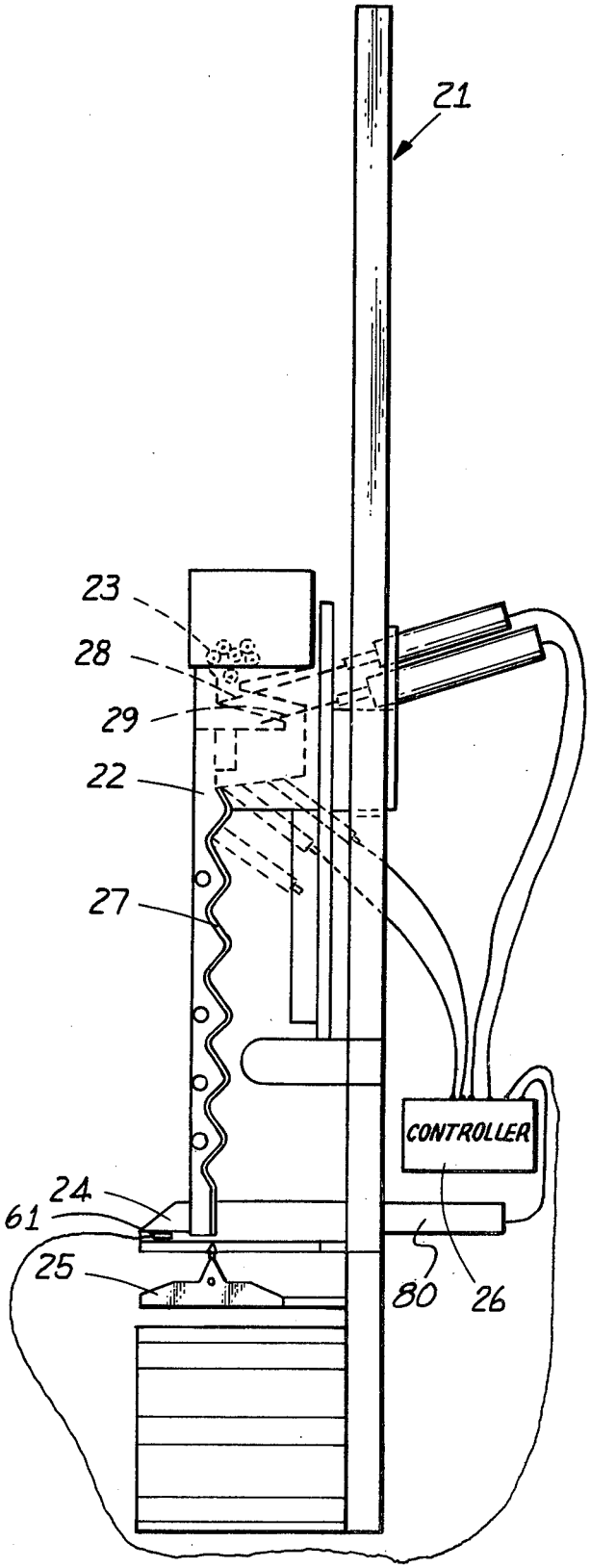
FIG. 1 is a front elevation view of the machine comprising a feeder-serializer, test head and orienter.

Referring now primarily to FIGS. 1 and 2 and also to FIGS. 3 through 16, an apparatus for handling cylindrical components is shown 21 that comprises a feeder-serializer assembly 22 adapted to receive bulk cylindrical components 23 and serialize the components into a single-file progression, a test head assembly 24 adapted to segregate and perform tests on individual components, an orienter assembly 25 adapted to rotate selected components 90-degrees clockwise or 90 degrees counterclockwise, as directed by signals from sequence controller 26, and conveyor track 27 to transport components single-file from the feeder-serializer to the test head, from the test head to the orienter, and to other destinations downstream from the orienter, as required.

Controller 26 also controls actuation of feeder-serializer gates 28 and 29, and actuation of test head escapement jaws 41 and 42, as will be fully described below.

As may be best seen in FIG. 1, the cylindrical parts handling apparatus 21 comprises a vertically-disposed configuration of subassemblies, namely; a component feeder-serializer 22, a conveyor track 27, a test head assembly 24, and an orienter assembly 25. The vertical disposition of the subassemblies enables the force of gravity to move components through and between the subassemblies. Auxiliary means such as a stream of pressurized gas may be used to decrease or increase the speed of parts descending through the apparatus. Vibration of the apparatus may also be employed to facilitate movement of components.

To facilitate understanding the structure and operation of the cylindrical parts handling apparatus, its use with semiconductor diodes will be described. That selection of component type is based on expediency alone, and it is to be recognized that the capability of the present invention is not limited to handling diodes. The invention is in fact capable of handling a large variety of cylindrical components in addition to diodes, including both electronic and non-electronic components.

For example, the test head assembly is adapted to permit non-electrical tests to be performed on cylindrical components introduced into the apparatus. Thus, in addition to performing electrical tests, the test head may employ optical, pneumatic or other means to measure the diameter, length, etc. of components.

OPERATION OF THE INVENTION

Figure 4:
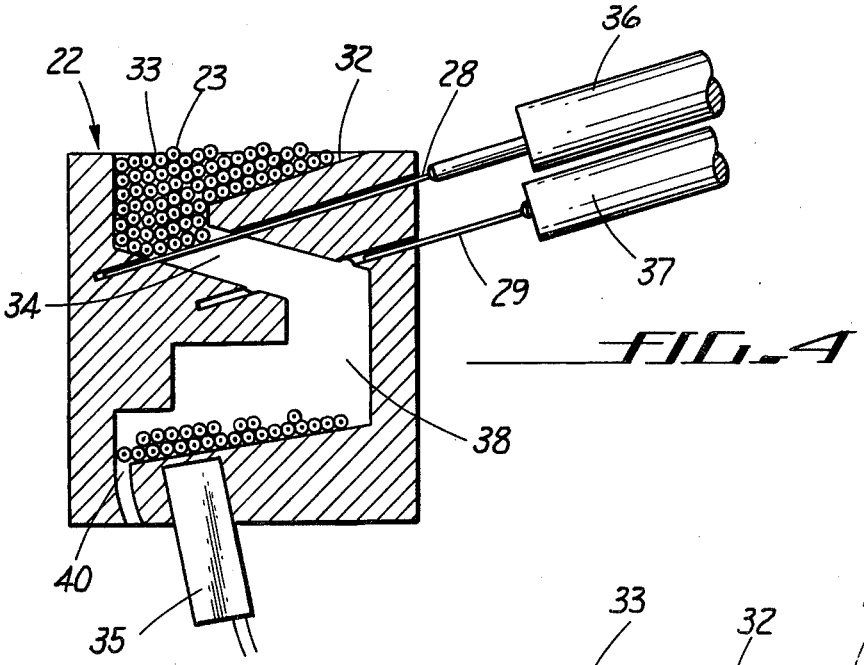
FIG. 4 is a partly sectional front elevation view of the feeder-serializer showing upper gate needles blocking transmission of components from the upper chamber to the intermediate chamber.
Figure 5:
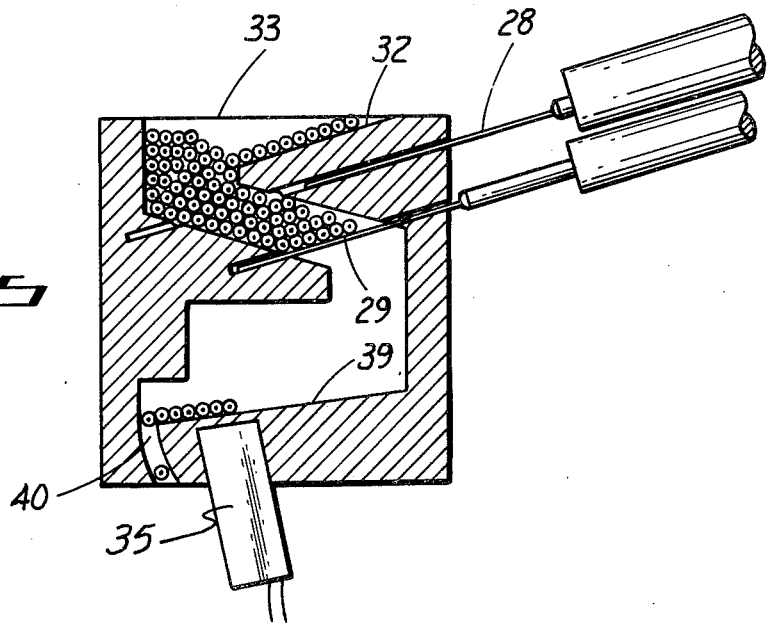
FIG. 5 is a partly sectional front elevation view of the feeder-serializer showing lower gate needles blocking transmission of components from the intermediate chamber to the lower chamber.

By way of example, referring now to FIGS. 3, 4 and 5, assume that the invention is to be employed to feed, test and orient semiconductor diodes 23. The diodes are initially brought into substantially parallel alignment by means external to the present invention. The diodes are next introduced to the upper chamber 32 of the feeder serializer 22 through entrance opening 33. Referring to FIG. 5, upper serializer control gate 28 is initially retracted to the right, permitting a quantity of the diodes to roll under the influence of gravity onto the top of lower control gate 29, which is initially extended into the left into the intermediate chamber 34. External vibration means may be employed to facilitate the downward progression of diodes.

When sensor 35 transmits a signal to controller 26 that indicates the lower chamber is empty and ready to receive diodes, two sequential output control signals are generated by the controller means. (Sensor 35 provides a different signal level output when components are above the sensor than when there are no components present. One such sensor type is a light emitting diode (LED) combined with a phototransistor to produce a retroreflective proximity detector. This detector type and others such as magnetic proximity detectors are well known to those skilled in the art.) The first-occurring output control signal is applied to the upper pneumatic or electromagnetic actuator 36, causing that actuator to extend the upper control gate 28 to the left into intermediate chamber 34, thus blocking entry of more diodes into intermediate chamber. After a time delay sufficient to permit full actuation to the left of control gate 28, a second timed control signal is applied to the lower pneumatic or electromagnetic actuator 37, causing that actuator to retract lower control gate 29 to the right, permitting an approximately measured number of diodes 23 to roll under the force of gravity into lower chamber 38.

After a sufficient time interval has elapsed to allow transfer of all diodes initially in intermediate chamber 34 to lower chamber 38, sensor 35 transmits a signal to controller 26 indicating that lower chamber 38 is full, at which time controller 26 generates a signal which is applied to lower actuator 37, extending lower control gate 29 to the left. After a time delay sufficient to permit full actuation to the left of lower control gate 29, controller 26 generates a signal which is applied to upper actuator 36, retracting upper control gate 28 to the right and permitting another quantity of diodes 23 to roll into and fill intermediate chamber 34.

At this point in the feeder-serializer operation cycle, an approximately measured number of diodes 23 is contained in the intermediate chamber 34, and an approximately measured number of diodes is contained in lower chamber 38. Under the force of gravity and external vibration diodes 23 roll on the floor 39 of lower chamber 38 towards exit opening 40 in lower chamber 38, ultimately falling through exit opening 40 into guide track 27. The number of diodes 23 per unit time which enter the guide track is a statistically determinate quantity depending on the slope of the floor 39 of lower chamber 38, the coefficient of rolling and sliding friction between the diodes and floor 39, and the vibration amplitude. The rate determining parameters are adjusted to give a diode flow rate sufficiently great to fill up the guide track 27 (FIG. 1) between the feeder-serializer and the next diode destination. In the present example, the next diode destination is the entrance to the test head assembly 24.

After the guide track has been filled, the required diode flow rate is determined by the throughput rate of the test head. To provide a diode flow rate sufficient to meet the utilization rate required by the test head, or other processing station, sensor 35 is used in conjunction with controller 26 to actuate upper control gate 28 and lower control gate 29, as follows.

When sensor 35 transmits a signal to controller 26 indicating that the approximate quantity of diodes in lower chamber 38 has reached a pre-determined minimum value, the controller produces a sequence of two signals which, when applied to actuators 36 and 37, first extends upper control gate 28 to the left, and then retracts lower control gate 29 to the right. That sequence of control gate actuations permits an approximately measured number of diodes to fall from the intermediate chamber 34 into the lower chamber 38, as has been described above.

By introducing a predetermined maximum number of diodes into the lower chamber, jamming of diodes entering the exit 40 in lower chamber 38 is prevented.

Also, by controlling the minimum number of diodes in lower chamber 38, a sufficient flow rate of parts into the guide track 27 is maintained to support the throughput rate requirements of the utilization station downstream from the feeder-serializer, which station is the test head in the present example.

The test head assembly, as may best be seen in FIGS. 6, 7, 13 and 14 comprises essentially two separate jaws 41 and 42 comprised of vertically-disposed parallel planes and located on opposite sides of the guide track 27. The left-hand jaw 41 comprised of front plane section 43 and rear plane section 44 has protruding triangular-shaped profiles facing right.

The right-hand test head section 42 has indented triangular-shaped profiles approximately matching the protruding profiles of the left-hand jaw 41 and is comprised of three different pairs of plane sections, namely; front upper jaw half 47 and rear upper jaw 48, front lower jaw halves 49 and rear lower jaw half 50, front pivotable electrodes 51 and rear pivotable electrodes 52. Springs 53 and 54 normally maintain the left-hand edges of the pivotable electrodes 51 and 52, respectively, in a downward position.

The test head components just described are mounted on bearing housing 55, which housing is free to travel horizontally on grooved support shaft 56 when actuated by a linear actuator, as air cylinder 57.

Figure 6:
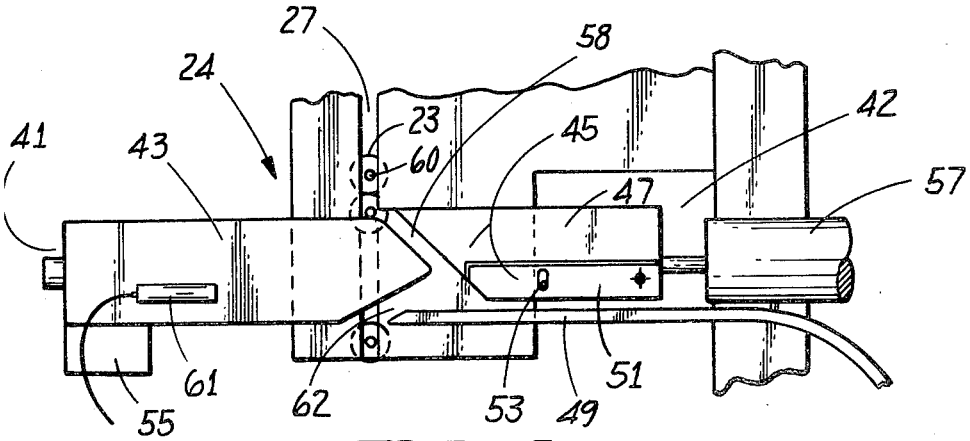
FIG. 6 is a partly sectional front elevation view of the test head showing a tested component being ejected from the test position and a new component in position to be picked up and forced into the test position.

Referring now to FIG. 6, test head assembly 24 is shown in its extreme right-hand position. To load the diode directly above and adjacent to the test head assembly into the test position, a signal from controller 26 is applied to actuator cylinder 57 to initiate leftward motion of the test head assembly 24 with respect to stationary guide track 27.

As the test head assembly 24 moves toward the left, front and rear diagonal tracks 58 and 59, formed by the intersections between plane sections 43 and 47, and 44 and 48, respectively, engage leads 60 of diode 23. Continued leftward motion of the test head assembly causes the diode leads and diode to progress downwardly in guide track 27 and downwardly and to the right along diagonal tracks 58 and 59, as viewed from the moving test head assembly. Downward progression of the diode is halted when the diode leads contact bottom electrodes 49 and 50. Further leftward movement of the test head assembly forces the front diode leads into an interference fit between front bottom electrode 49 and front pivotable electrode 51 and forces the rear diode lead into an interference fit between rear bottom electrode 50 and rear pivotable electrode 52, as shown in FIG. 7.

Figure 7:
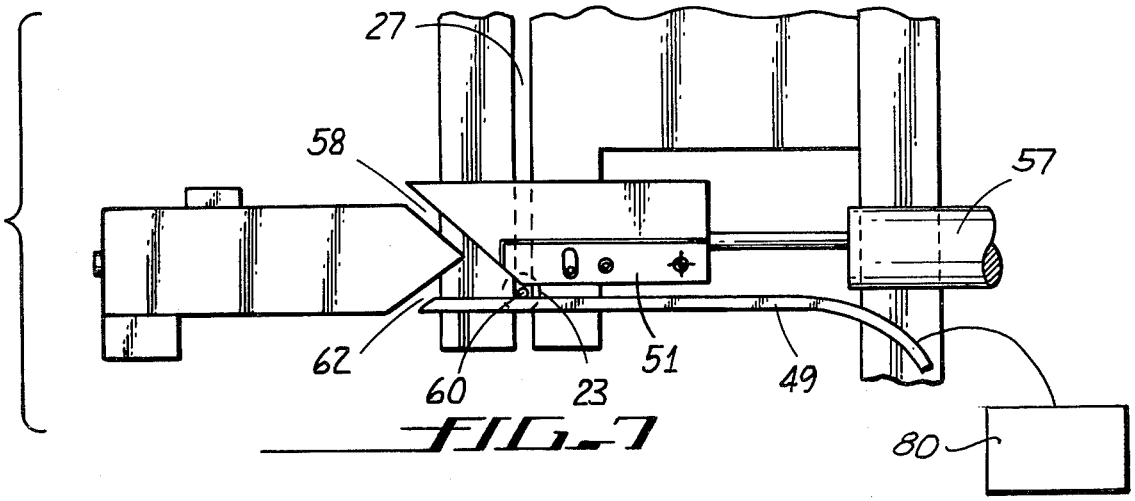
FIG. 7 is a partly sectional front elevation view of the test head showing a component in the test position.
Figure 8:
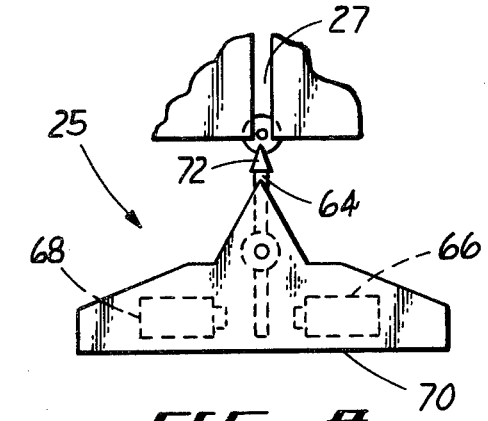
FIG. 8 is a front elevation view of the orienter with a component and levers in a neutral position prior to the directing of the component to one of the alternate positions.
Figure 9:
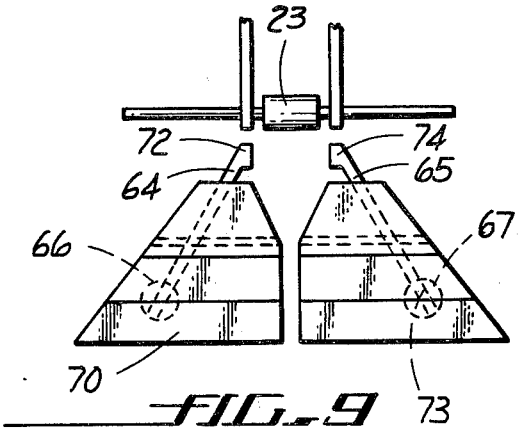
FIG. 9 is a side elevation view of the orienter with component in same position as in FIG. 8.
Figure 16:
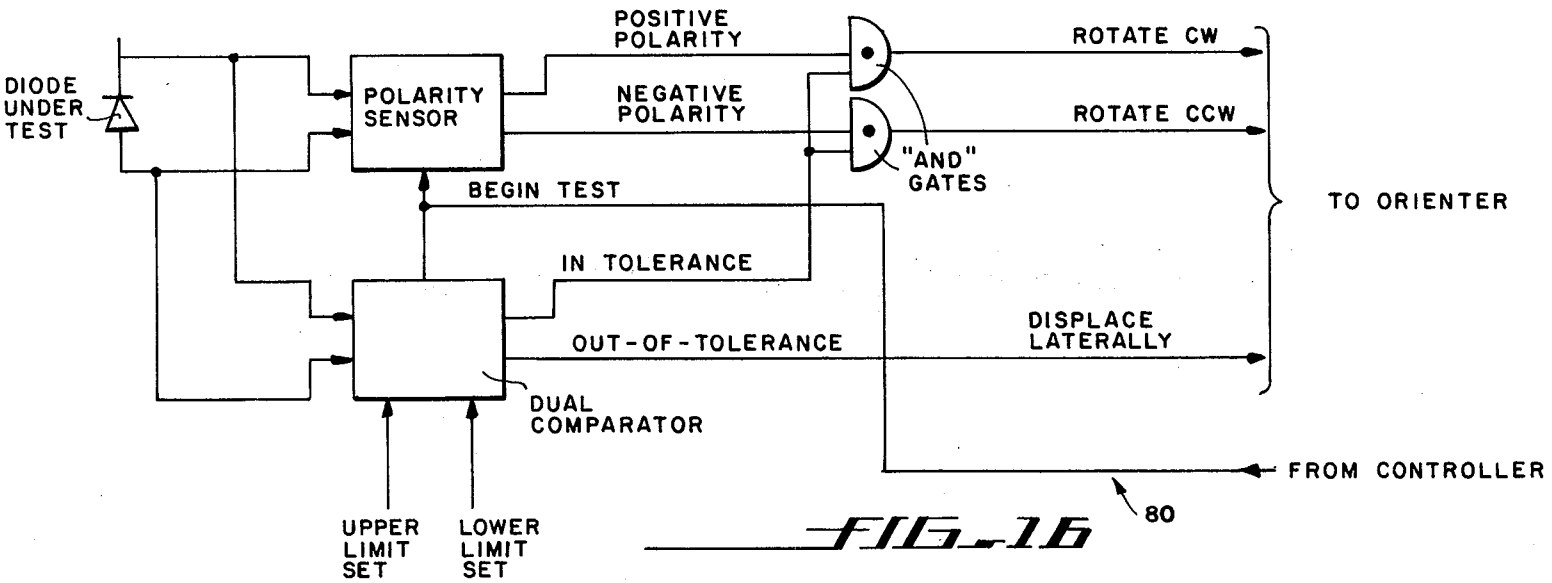
FIG. 16 is a block diagram of one embodiment of a component value and polarity test device for the apparatus.

With diode 23 in the test position shown in FIG. 7, leftward motion of the test head assembly is caused to cease by cylinder reaching end of its travel. Sensor 61 detects the presence of diode 23, sending a signal to controller 26 which initiates the test cycle. Sensor 61 is the same type of sensor as described for sensor 35. The diode under test is held in the test position sufficiently long to perform the required tests, such as conductance and polarity tests, and diode test parameter values stored in controller 26. As shown in FIG. 16, a component value and polarity measurement device 80 may directly compare diode conductance and polarity with predetermined values and generate one signal to command the orienter to rotate positive polarity diodes clockwise (CW), a second signal to rotate negative polarity diodes counter-clockwise (CCW), and a third signal to laterally displace out-of-tolerance diodes. Whether the control signals are generated in the component and polarity measurement device 80 or the controller 26 is a matter of ordinary choice to one skilled in the art.

Upon completion of required tests upon the diodes, a controller signal is applied to actuator 57 to initiate rightward movement of test head assembly 24 with respect to stationary guide track 27. As the test head assembly moves toward the right, diagonal tracks 62 and 63, formed by the intersection between plane sections 43 and 49, and 44 and 50, respectively, engage the leads 60 of tested diode 23. Continued rightward motion of the test head assembly causes the diode leads and atrached diode to progress downwardly in guide track 27 and downwardly and to the left along diagonal tracks 62 and 63, as viewed from the moving test head assembly.

When rightward motion of test head assembly 24 has reached a pre-determined limit, motion of the test head assembly is caused to cease by reaching the travel limit of the actuator. At this point, the test head assembly is positioned relative to guide track 27 as shown in FIG. 6, permitting tested diode 23 to progress downward through the guiding track. With the test head assembly in its extreme right-hand position as shown in FIG. 6, the test head assembly is in position to load the next diode into the test position, which loading operation has been described above. Thus a first leftward excursion of the test head assembly, followed by a second rightward excursion completes a cycle of loading, testing and ejecting a diode from the test head assembly.

The orienter 25, as may best be seen from FIGS. 8–12 comprises two independently pivotable levers; front pivotable lever 64 and rear pivotable lever 65; right front electromagnet 66, right rear electromagnet 67, left front electromagnet 68, left rear electromagnet 69 and support structure 70. Assume now, for example, that it is desired to impart a counterclockwise (as viewed from above) rotation to diode 23 directly above the upper tips of pivotable levers 64 and 64, the diode lying within guide track 27. To effect the counterclockwise rotation, a signal from controller 26 is applied to right-front electromagnet 66, thus moving upper tip 72 of the front lever counterclockwise to the left as viewed from the front, FIG. 10. Similarly, a signal from the controller is simultaneously applied to left-rear electromagnet 69, attracting ferromagnetic lower end 73 of rear lever 65, thus moving upper 76 of the rear lever clockwise to the right, as viewed from the front, FIG. 10. The simultaneous movement of the upper tips of the front and rear levers from positions blocking the leads of diode 23 from downward movement, permits the diode leads and attached diode to move downward and counterclockwise as viewed from above the orienter.

Figure 10:
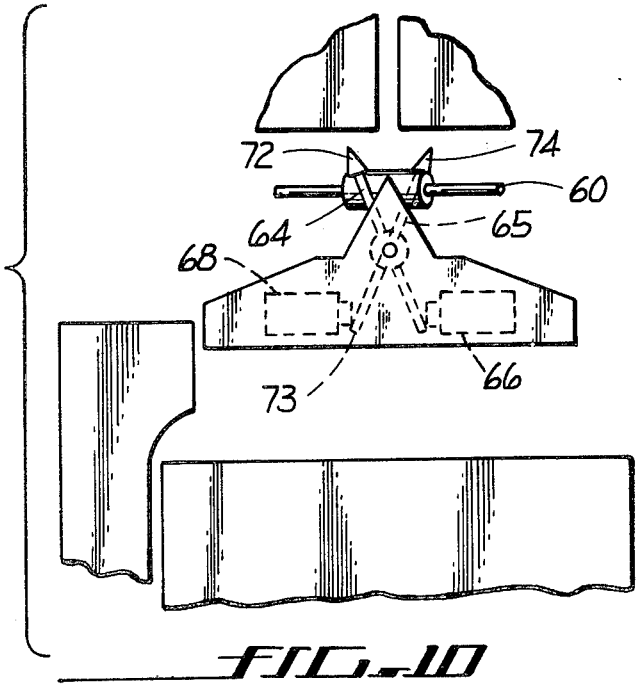
FIG. 10 is a front elevation view of the orienter, with control levers actuated to initiate a 90-degree, counterclockwise rotation of a selected component, as viewed from the top.
Figure 11:
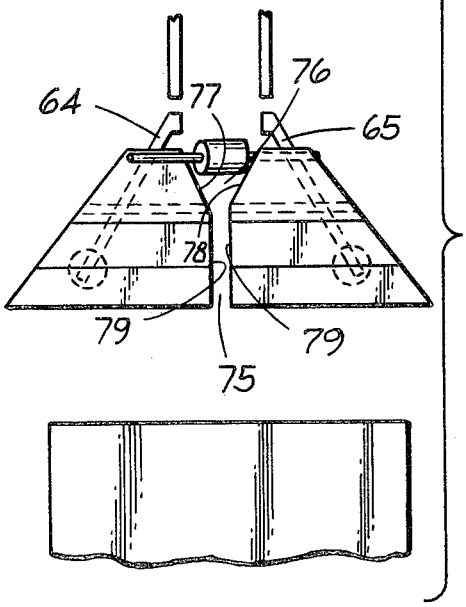
FIG. 11 is a side elevation view of the orienter showing the downward progression of a component that has just been rotated counterclockwise.
Figure 14:
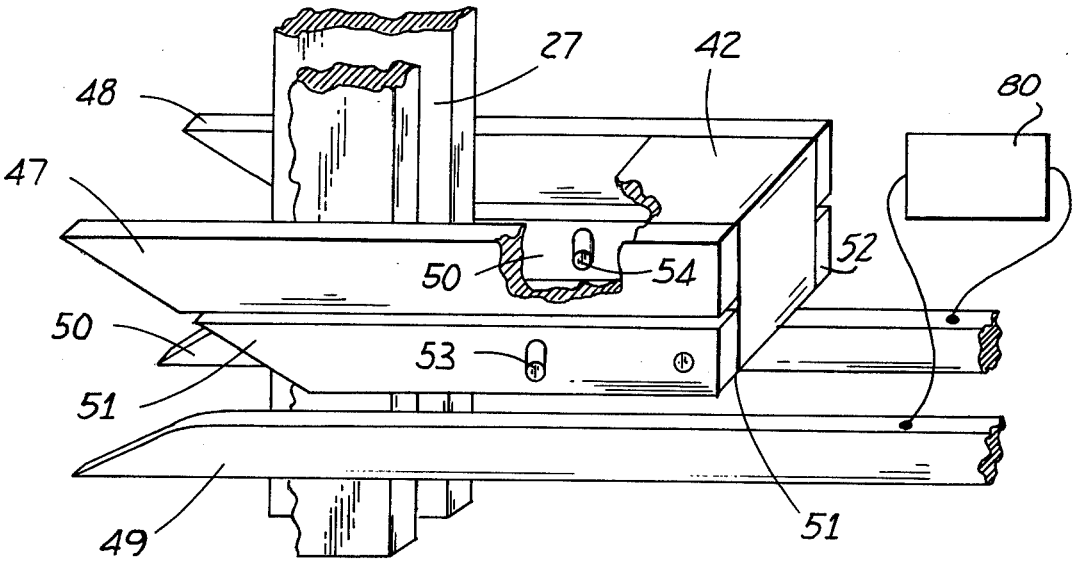
FIG. 14 is a partly sectional end elevation view of the right-hand jaw assembly of the test head.

As shown in FIGS. 10 and 11, releasing diode 23 from its position bottommost in upper guide track 27 permits the diode to fall into the upwardly-divergent tapered end of lower guide track 75. As the diode continues falling downward within tapered upper guide-track 76, narrowing clearance between walls 77 and 78 of the lower guide track force the diode to rotate counterclockwise as it progresses downward. When the diode has reached the intersection between the tapered walls and parallel vertical walls 79 of lower guide track 75, the diode has been rotated 90 degrees counterclockwise, permitting the diode to enter the lower guide track, which track is oriented 90 degrees clockwise with respect to the upper guide track.

In an exactly analogous way, the controller 26 may generate drive signals for the left-front electromagnet 68 and right rear electromagnet 67 to effect a clockwise rotation of diode 23 exiting from the bottom of upper guide track and entering orienter 25.

Now since a diode that has been rotated 90 degrees clockwise from its original position in the upper guide track lies in the lower guide track at an angle of 180 degrees with respect to a diode that has been rotated 90 degrees counterclockwise, it is apparent that the orienter is capable of effecting a 180-degree relative rotation to selected diodes. Thus a diode which is determined by test head assembly 24 and controller 26 to have the opposite polarity to that desired in the serial train of diodes processed by the orienter, may be rotated 180 degrees with respect to its position in the upper guide track 27, giving it the correct orientation with respect to the other diodes exiting from the orienter.

The orienter 25 is also adapted to directing selected diodes to destinations different from lower guide track 75. Thus, for example, as may be seen in FIG. 12, by simultaneously actuating left front electromagnet 68 and left rear electromagnet 69, diode 23 will be released from upper track guide 27 and permitting it to roll downward and to the left. Similarly, simultaneous actuation of right front electromagnet 66 and right rear electromagnet 67 will release a diode from the upper guide track and permit it to roll downward and to the right.

Figure 15:
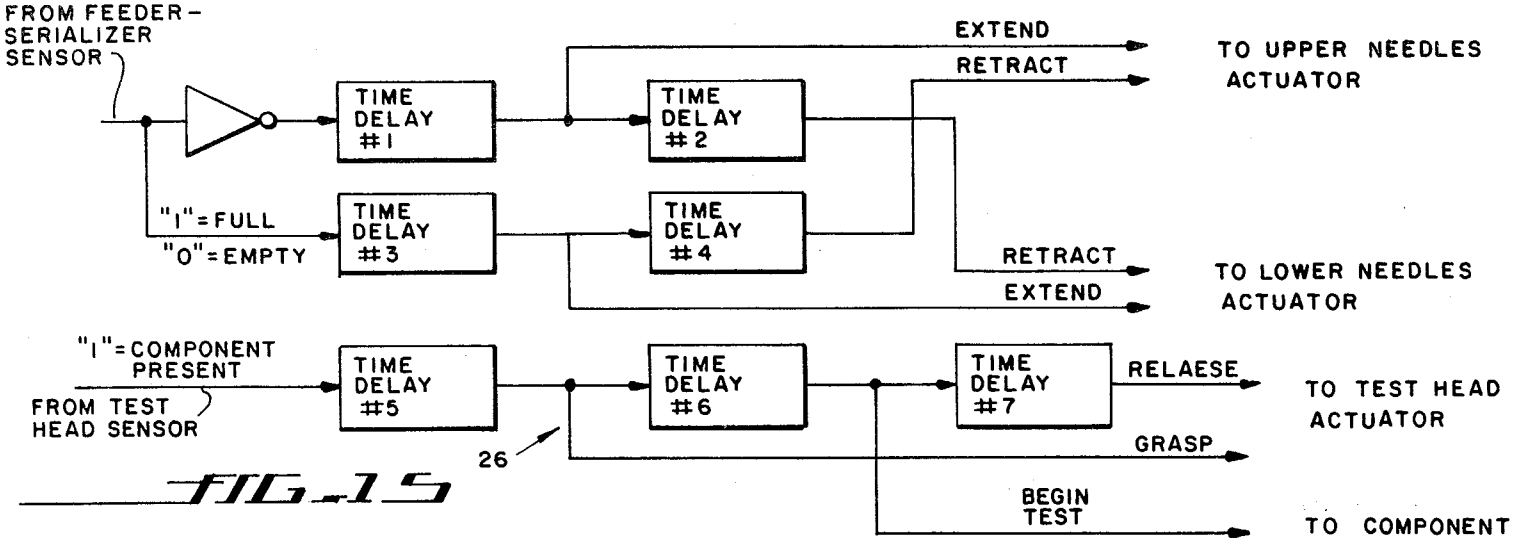
FIG. 15 is a block diagram of one embodiment of a sequence controller for the apparatus.

FIGS. 15 and 16 are block diagrams of typical implementations of a component value and polarity tester, and a controller, respectively. It will be recognized by one skilled in the art that the functions there depicted in block form can be implemented using relay logic and analog measurement circuits, integrated circuits, or a microcomputer, to cite just a few examples.

What is claimed is:

1. An apparatus for producing a serial progression of cylindrical components, testing the components, orienting the components to either of two anti-parallel orientations and rejecting out of tolerance components comprising:

(a) a feeder-serializer assembly for receiving bulk cylindrical components and producing a single file progression of components therefrom, (b) a first conveyor track for transporting single-file progressions of cylindrical components from the feeder-serializer assembly to a test head assembly, (c) a test head assembly for selecting and grasping a single component confined within the first conveyor track, isolating the selected component, testing the component and releasing the tested component to permit resumption of its motion within the first conveyor track, (d) an orienter assembly for rotating a selected component of one polarity ninety degrees clockwise about a vertical axis perpendicular to the cylindrical axis of the component, rotating a component of the opposite polarity ninety degrees counterclockwise about a vertical axis perpendicular to the cylindrical axis of the component, and imparting a lateral displacement to out-of-tolerance components, (e) a second conveyor track for transporting single file progressions of cylindrical components rotated about a vertical axis ninety degrees with respect to the components entering the orienter assembly, (f) at least one sensor to determine the quantity and location of components in the feeder-serializer assembly, (g) at least one sensor to determine the presence of a component in the test head assembly, (h) at least one device to measure component parameter values and polarities and, (i) a controller having means for storing measured component parameter values and polarities, comparing the values and polarities with predetermined values and polarities, actuating the orienter assembly to impart a ninety degree clockwise rotation to components having one measured polarity, a ninety-degree counterclockwise rotation to components having an opposite measured polarity a lateral displacement to out-of-tolerance components, responsive to feeder-serializer sensor signals to control operation of the feeder-serializer assembly, and responsive to test head assembly sensor signals to control operation of the test head assembly.

2. The apparatus of claim 1 wherein the feeder-serializer assembly comprises (a) an upper entrance chamber, (b) an intermediate storage chamber, (c) a lower exit chamber, (d) means for blocking movement of components from the upper chamber to the intermediate chamber, (e) means for blocking movement of components from the intermediate chamber to the lower chamber and (f) at least one sensor to determine the quantity of components in the lower chamber.

3. The apparatus of claim 1 wherein the test head assembly comprises (a) a left-hand jaw assembly comprised of plane parallel sections disposed on both sides of the first conveyor track, parallel to the front and rear surfaces respectively of the track and perpendicular to the direction of which the components are capable of being moved within the track, (b) a right-hand jaw assembly comprised of plane parallel sections disposed on both sides of the first conveyor track, parallel to the front and rear surfaces respectively of the track and perpendicular to the cylindrical axes of the components in the track, the front plane parallel section of the right-hand jaw assembly being displaced rightward from the front plane parallel section of the left hand jaw assembly to produce a front angular slot adapted to receiving those portions of the components in the conveyor track which protrude forward through a front slot in the conveyor track, the rear plane parallel section of the right-hand jaw assembly being displaced rightward from the rear plane parallel section of the left-hand jaw assembly to produce a rear angular slot adapted to receiving those portions of the components in the conveyor track which protrude rearward through a rear slot in the conveyor track, (c) means for holding the right and left hand jaw assemblies in fixed relation with respect to one another, (d) means for reciprocally actuating the holding means so as to effect a reciprocal motion of the right and left hand jaw assemblies in a direction parallel to the plane parallel faces of the jaw assemblies and perpendicular to the slots in the conveyor track.

4. The apparatus of claim 1 wherein the orienter assembly comprises (a) a front pivotable lever pivotable in a vertical plane which in its normal vertical position blocks downward movement of that portion of a cylindrical component which protrudes forward through the front slot of the first conveyor track, which front pivotable lever permits the blocked forward portion of the component to roll downward and to the left when the upper portion of the lever is pivoted clockwise to the right and permits the blocked forward portion of the component to roll downward and to the right when the upper portion of the lever is pivoted counterclockwise to the left, (b) a rear pivotable lever pivotable in a vertical plane which in its normal vertical position blocks downward movements of that portion of a cylindrical component which protrudes rearward through the rear slot of the first conveyor track, which rear pivotable lever permits the blocked portion of the component to roll downward and to the left when the upper portion of the lever is pivoted clockwise to the right, and permits the blocked rear portion of the component to roll downward and to the right when the upper portion of the lever is pivoted counterclockwise to the left, (c) first independent means for effecting clockwise and counterclockwise motion in a vertical plane of the front pivotable lever, (d) second independent means for effecting clockwise and counterclockwise motion in a vertical plane of the rear pivotable lever, and (e) a transition section disposed between the front and rear pivotable levers having a relatively large opening to receive components partially rotated by actuation of front and rear pivotable levers in opposite directions, which transition section has downward and inwardly tapering interior wall spacing terminating in an outlet to the lower conveyor track.

* * * * *